US007431388B2

(12) United States Patent
Sharapov

(10) Patent No.: US 7,431,388 B2
(45) Date of Patent: Oct. 7, 2008

(54) CHAIR WITH A BUILT-IN SUN-PROTECTIVE DEVICE

(76) Inventor: Sergey Sharapov, 18 Dorado Ter. #7, San Francisco, CA (US) 94112

( * ) Notice: Subject to any disclaimer, the term of this patent is extended or adjusted under 35 U.S.C. 154(b) by 58 days.

(21) Appl. No.: 11/633,104

(22) Filed: Dec. 4, 2006

(65) Prior Publication Data

US 2008/0129091 A1 Jun. 5, 2008

(51) Int. Cl.
*A47C 29/00* (2006.01)

(52) U.S. Cl. ..... 297/184.11; 297/184.15; 297/184.17

(58) Field of Classification Search ..... 297/184.1, 297/184.11, 184.15, 184.17; 135/16, 20.3, 135/25.1

See application file for complete search history.

(56) References Cited

U.S. PATENT DOCUMENTS 4,687,249 A * 8/1987 Mills ..... 297/184.15
4,930,838 A * 6/1990 Brabant ..... 297/184.14
5,096,257 A * 3/1992 Clark ..... 297/184.15
5,135,281 A 8/1992 Pappalardo
5,203,363 A * 4/1993 Kidwell et al. ..... 297/184.15
5,582,458 A * 12/1996 Wildt ..... 297/184.15 X
5,797,650 A * 8/1998 Gonzalez et al. ..... 297/184.1
5,873,625 A * 2/1999 Uchtman ..... 297/184.15
6,234,187 B1 5/2001 Izzo
6,405,742 B1 6/2002 Driscoll
6,582,018 B2 6/2003 Tseng
7,048,333 B2 5/2006 Martinez

FOREIGN PATENT DOCUMENTS

GB 2052960 A * 2/1981

* cited by examiner

*Primary Examiner*—Anthony D. Barfield

(57) ABSTRACT

A chair, preferably a beach chair, equipped with a simple, foldable, and lightweight sun-shading device that is integrally connected with or built into the chair and, when not in use, is hidden inside the body of the chair. The sun-shading device comprises retractable rods telescopically fitted into hollow tubular members of the chair frame and strips retractable from the armrests of the chair with cords. The extreme ends of the rods and strips are connected by cords that are tensioned when the rods and the strips are retracted to a working position of the sun-shading device. The cords are used as guides for positioning the sun-shading blind that can slide along the cords into the required shading position over the chair's occupant.

8 Claims, 3 Drawing Sheets

CHAIR WITH A BUILT-IN SUN-PROTECTIVE DEVICE

FIELD OF THE INVENTION

The invention relates to a sun-protective cover, in particular, to a chair with a sun-protective device built into the frame of the chair and retractable from the chair frame for unfolding to a working position.

BACKGROUND OF THE INVENTION

On sunny days in the summer many people frequently go to beaches or just spend time outdoors in lounge chairs while resting, relaxing, or reading. It is known, however, that long exposure to direct sun rays is dangerous because it may develop skin cancer. In addition, it is difficult and unhealthy to read under direct sun rays, and, therefore, on hot and sunny days some people prefer to use sun-protective covers or blinds. Many public and private beaches are equipped with beach chairs that are not always equipped with sun shades or blinds.

Heretofore, many proposals have been made aimed at providing beach chairs with sun-protective means. For example, U.S. Pat. No. 5,135,281 issued in 1992 to E. Pappalardo, relates to chair sun shades, especially to chair sun shades that are collapsible and detachable from the frame, made of a disposable, replaceable, and imprintable type of material. The device consists of two plastic strips attached by their base ends to the vertical frame supports on the back of a chair with hook-and-loop fastener strips known under the Velcro trademark. The strips, which are flexible, support a sun-shade material, e.g., a fabric or a plastic film. Connected to the distal ends of the plastic strips are cords. When the opposite ends of the cords are attached to the back of the seat, the plastic films are bent in such a manner that they form an arch-shaped canopy above the chair seat and hence above the chair's occupant. A disadvantage of the device of U.S. Pat. No. 5,135,281 is that the sun-shading attachment normally is not permanently attached to the chair and can be separated from the chair and stored in a different place or misplaced and not always found when needed. U.S. Pat. No. 6,234,187 issued in 2001 to L. Izzo discloses an adjustable umbrella apparatus comprising an umbrella with a canopy and a rod. A connector is attached to the rod and has a pair of prongs extending therefrom. The connector is disposed within a channel formed in an umbrella base. The connector prongs are spring-loaded relative to the connector body within the channel and, when released, the prongs are urged through corresponding lock holes to retain the umbrella in a desired position relative to the umbrella base. When the spring-loaded prongs are compressed, the connector may be slid within the channel longitudinally or rotatably relative to the longitudinal axis of the channel. In this manner, the umbrella can be adjusted longitudinally and rotatably to a chosen orientation and held securely in place in that chosen orientation. The umbrella base is formed integral with or attachable to a framed chair such as a beach chair. The umbrella of U.S. Pat. No. 6,234,187 entails the same disadvantages as the device of the previous U.S. patent.

U.S. Pat. No. 7,048,333 issued in 2006 to R. Martinez discloses a collapsible sun shade adapted to be used with a chair. The shade is made of spring steel or equivalent material and is adapted to be affixed to cover the seat portion of a lounge chair. The shade is unfolded under the force of the compressed spring and attached to the chair to provide shade over the seat of the chair. A disadvantage of the device of this patent is that the flexible sheet, irrespective of whether it is made of metal or plastic, cannot be folded and occupies a large area in storage. The sheet has to be sufficiently large in order to be above the head of the chair's occupant when used. Furthermore, the flexible sheet is normally separated from the chair and can be misplaced in storage.

Thus, a common disadvantage of known sun-shading devices intended for use in conjunction with a chair is that these devices are relatively large in size, do not constitute an integral part of the chair, and require additional space for storage.

SUMMARY OF THE INVENTION

It is an object of the invention to provide a chair equipped with a simple, foldable, and lightweight sun-shading device that is integrally connected with or built into the chair and, when not in use, is hidden inside the body of the chair. It is another object of the invention to provide a chair with the aforementioned device that can be easily retracted to a sun-shading position without interfering with the positions of the chair's occupant. It is a further object to provide a chair with a sun-shading device that does not need a separate space for storage but can be withdrawn into the body of the chair frame and stored together with the chair. Still another object is to provide a sun-shading device that does not require time for connection to the chair and can be easily retracted to a working position by merely pulling it out from the hollow parts of the chair frame into which the frame of the sun-shading device is telescopically inserted.

The chair of the invention consists of a chair, per se, and a sun-shading device integrally connected to the chair. Preferably, the chair has a foldable construction with the chair seat pivotally connected to the chair back. The part of the chair that supports the occupant's body is made from a strong fabric stretched between the tubular elements of the chair frame. The frame part of the chair back is made in the form of two parallel and hollow tubes that contain telescopically extendable rods which form a U-shaped frame retractable in the upward direction from the parallel hollow tubes. On the other hand, the horizontally arranged armrests have guides for slidingly supporting the retractable strips. The extreme ends of the retractable strips and the outer ends of the vertical members of the U-shaped frame are connected to the ends of respective cords or strings. In a withdrawn position of the U-shaped frame, the cords are loose and are hidden in longitudinal grooves formed on the upper surface of the armrests of the chair seat. When the U-shaped frame is retracted and the horizontal, retractable strips are extended forward along the guides of the armrests, the cords, or strings, are stretched in a diagonal direction from the upper end of the U-shaped frame to the outer ends of the extended horizontal strips. The cords are used as guides for a piece of a sun-shading cloth or blind that is stretched in a transverse direction between the cords and can slide along them to the required position above the chair's occupant. In a nonretracted position, the cloth, or blind, is held in a folded condition on the back side of the chair.

DETAILED DESCRIPTION OF THE INVENTION

Figure 1:
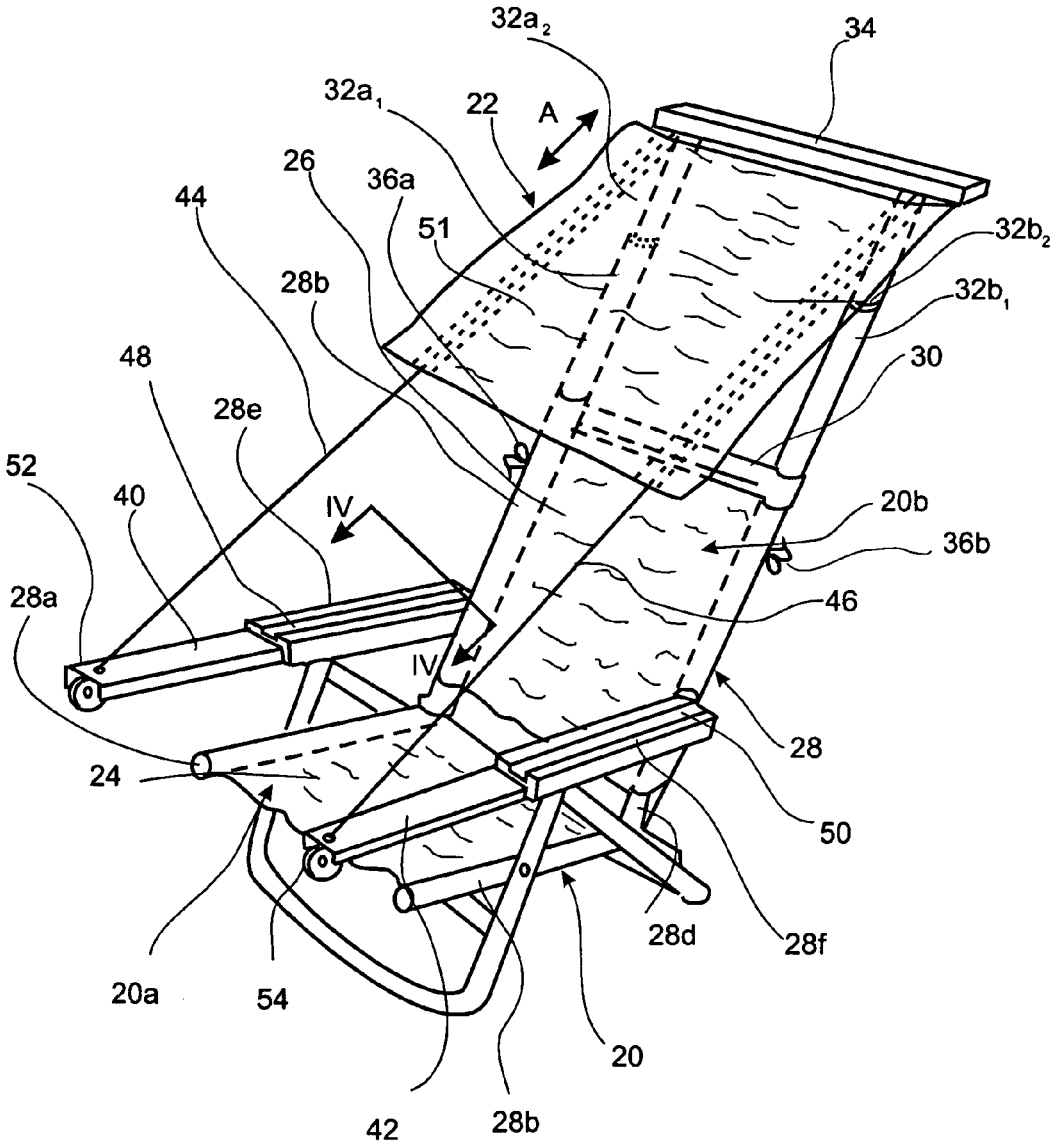
FIG. 1 is a general three-dimensional view of the chair of the invention with a built-in sun-shading device in a working position.

The chair of the invention with a built-in sun-shading device is shown in FIG. 1, which is a general three-dimensional view of the chair of the invention with a built-in sun-shading device in a working position. The chair of the invention consists of a chair, per se, which in FIG. 1 is designated by reference numeral 20, and a sun-shading device, which is built into the chair 20 and is designated by reference numeral 22. Preferably, the chair 20 has a foldable construction with a chair seat frame 20*a* pivotally connected to the chair back 20*b*. The parts of the chair seat that support the occupant's body are made from pieces 24 and 26 of a strong fabric stretched between the tubular elements 28*a*, 28*b*, 28*c*, and 28*d* of the chair frame 28. Reference numerals 28*e* and 28*f* designate respective armrests.

The aforementioned tubular elements 28*b* and 28*d* that form the back frame of the chair, i.e., the part of the chair frame 28 that supports the back of the chair's occupant, comprises two parallel, hollow tubes that are linked by a cross bar 30. The hollow tubes 28*b* and 28*d* contain telescopically extendable rods. Similar to a telescopic antenna, each rod may consist of two or more concentric extendable links such as rods 32$a_1$, 32$a_2$, 32$b_1$, and 32$b_2$. The upper ends of the extendable rods 32$a_2$ and 32$b_2$ are interconnected by a cross bar 34. In the folded or inoperative position of the sun-shading device 22, the rods 32$a_1$, 32$a_2$, 32$b_1$, and 32$b_1$ are withdrawn into the tubular elements 28*a* and 28*b* so that the rods of the sun-protective device 22 are hidden inside elements of the back frame and are not seen from the outside, except for the cross bar 34 that can be used as a handle for extraction of the rods.

Figure 2:
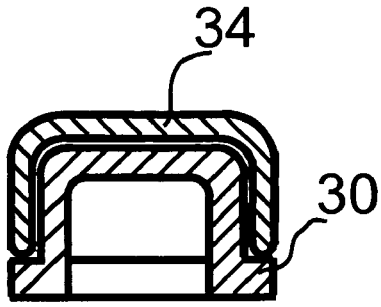
FIG. 2 is a cross-sectional view that illustrates the position of the cross-bar of the retractable part of the frame on the cross bar of the chair frame in a nonoperative position of the sun-shading device.

FIG. 2 is a cross-sectional view that illustrates the position of the cross bar 34 on the cross bar 30 of the chair frame in the inoperative position of the sun-shading device 22. It can be seen that the cross bar 34 has a U-shaped cross-section and can be conveniently supported by the cross bar 30 of the chair frame onto which it is fitted.

Figure 3:
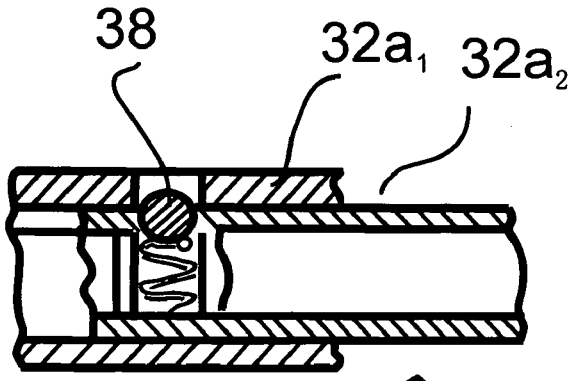
FIG. 3 is a sectional view of the mechanism used for locking the elements of the sun-shading device in an extended position.

The extendable rods 32*a* and 32*b* can be fixed in the extracted state, shown in FIG. 1, by clamps 36*a* and 36*b*, or by a locking mechanism of the type shown in FIG. 3, which consists of the spring-loaded ball 38 that locks together two telescopically sliding rods, e.g., 32$a_1$ and 32$a_2$, by protruding from one rod (32$a_1$) into a recess of the adjacent sliding rod (32$a_2$).

Figure 4:
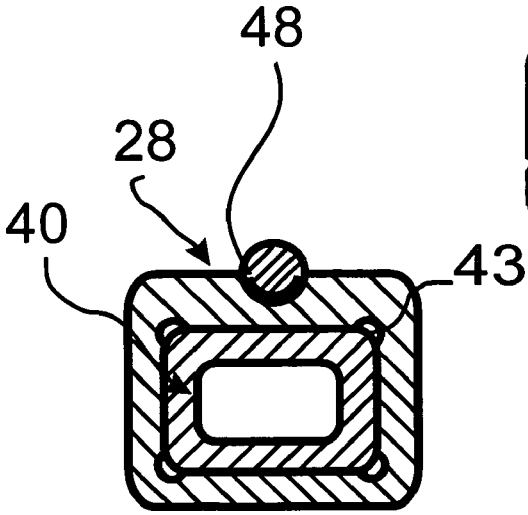
FIG. 4 is a cross-sectional view along the line IV-IV of FIG. 1.

The horizontally arranged armrests 28*e* and 28*f*, have guides for slidingly supporting retractable strips 40 and 42 (FIG. 1). FIG. 4, which is a cross-sectional view along the line IV-IV of FIG. 1, shows arrangement of the strip 40 in the guide slot 43 formed inside the armrest 28*e*. The arrangement of the retractable strip 42 in the armrest 28*f* is the same. The extreme ends of retractable strips 40 and 42 and the outer ends of the retractable rods 32$a_2$ and 32$b_2$ are connected to the ends of respective cords, or strings, 44 and 46. In the inoperative position of the sun-shading device, the strips 40 and 42 are withdrawn into positions completely hidden in the armrests 28*e* and 28*f*.

When the U-shaped frame formed by the retractable rods 32$a_1$, 32$a_2$, and 32$b_1$, 32$b_2$ and the strips 40 and 42 are withdrawn, the cords 44 and 46 are loosened and are inserted into longitudinal grooves 48 (FIGS. 1 and 4) and 50 (FIG. 1) which are formed on the upper surfaces of the armrests 28*e* and 28*f* of the chair seat frame 20. When the U-shaped frame formed by the retractable rods 32$a_1$, 32$a_2$, and 32$b_1$ and the strips 40 and 42 are extended forward from the guides of the armrests 28*e* and 28*f*, the cords 44 and 46 are stretched in a diagonal direction from the upper end of the U-shaped frame to the outer ends of the extended horizontal strips 40 and 42. The cords 44 and 46 are used as guides for a piece of sun-shading cloth, or blind, 51 that is stretched in the transverse direction between the cords 44 and 46 and that can slide along the cords in the direction of the arrows A shown in FIG. 1 to the required position above the chair's occupant. The blind can be made from a strong heat-resistant and substantially light-impermeable fabric. In the nonextended position, the cloth, or blind, 51 is held in the folded condition on the back side of the chair.

Figure 5:
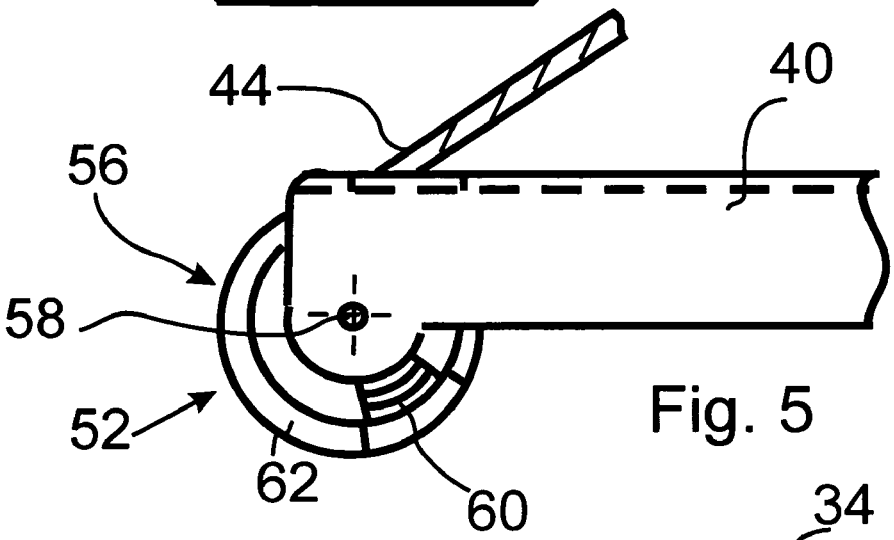
FIG. 5 is a side view of the cord-winding device attached to the end of the retractable strip.

Reference numerals 52 and 54 designate spring-loaded cord-winding devices of the type used in a tape measure with automatic withdrawal of the tape. One of these cord-winding devices, e.g., the winding device 52, is shown on a larger scale in FIG. 5. The device consists of a cylindrical cassette 56 that is rigidly connected to the end of the retractable plate. The cassette rotatingly supports a bobbin 60 that is rotatingly installed on an axle 58. The end of the string 44 is connected to the bobbin 60. The latter is connected to the cassette 56 through a spiral spring 62 that turns the bobbin 60 in the clockwise direction and that keeps the cord 44 in a stretched condition, as shown in FIG. 1. When the strips 40 and 42 are withdrawn into the armrests 28*e* and 28*f* and the rods 33*a*1, 32*a*2, 32*b*1, and 32*b*2 are pushed back into the tubular elements 28*a* and 28*b*, the cords 44 and 46 are loosened and guided into the grooves 48 and 50 (FIGS. 1 and 4).

Figure 6:
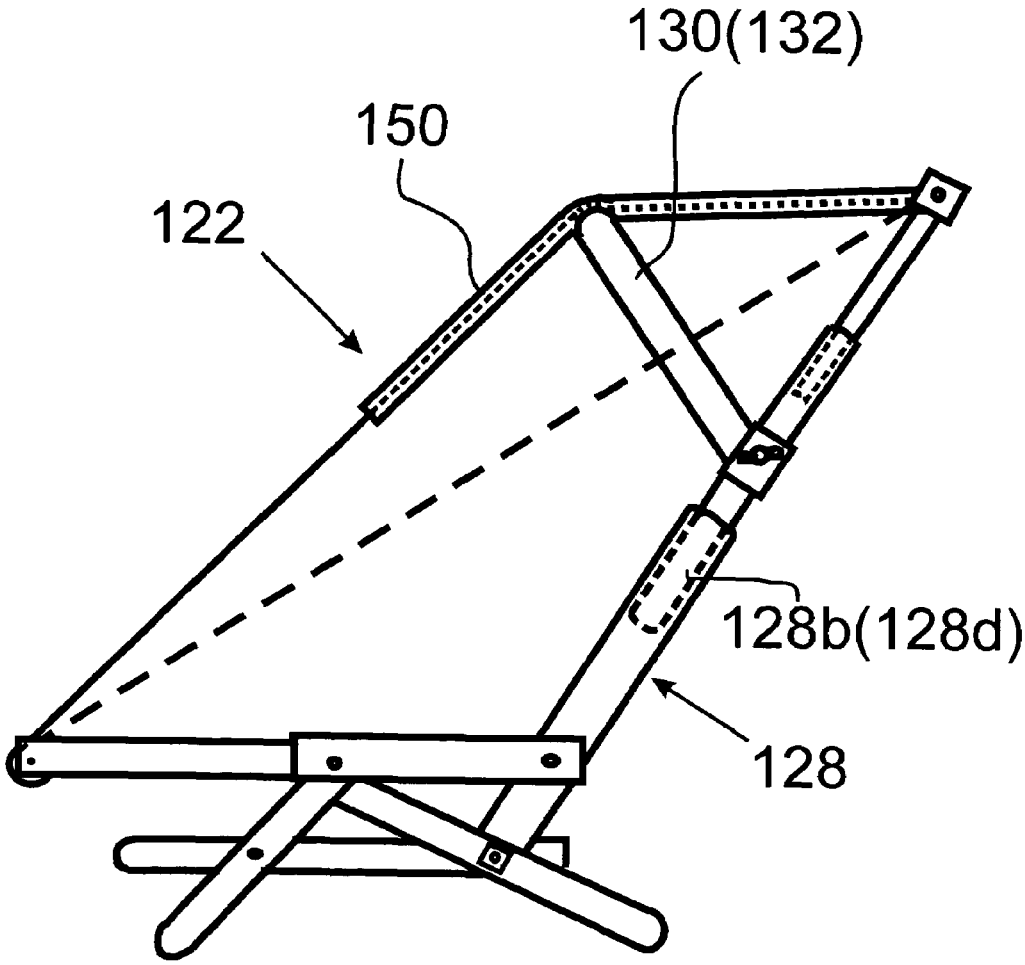
FIG. 6 is a side view of the chair made in accordance with another embodiment of the invention in which the chair frame is provided with blind-tensioning arms.

FIG. 6 is a side view of the chair made in accordance with another embodiment of the invention. According to this embodiment, the tubular elements 128*b* and 128*d*, which form the part of the chair frame 128 that supports the back of the chair's occupant, pivotally support a pair of blind-tightening arms (132). Only one of the tubular elements, i.e., 128, and only one arm, i.e., arm 130, are seen in the side view of the chair shown in FIG. 6. The aforementioned pair of blind-tightening arms 130 (132) can be turned between the first position where the blind-tightening arms 130 (132) rest on the hollow tubular members 128*b* (128*d*) of the chair back frame and the second position where said blind-tightening arms 130 (132) raise the sun-shading blind 150 above the chair's occupant (not shown). In other words, in a working position of the sun-shading device 122, the blind-tightening arms 130 (132) can be turned into the position shown in FIG. 6 so that the ends of the arms 130 (132) raise the flexible blind 150 higher above the head of the chair's occupant (not shown), thus providing a greater space between the blind 150 and the surfaces that support the body of the chair's occupant.

Thus, it has been shown that the invention provides a chair equipped with a simple, foldable, and lightweight sun-shading device that is integrally connected with or built into the chair and, when not in use, is hidden inside the body of the chair. The aforementioned device can be easily unfolded to a sun-shading position without interfering with the positions of the chair's occupant. The sun-shading device does not need a separate space for storage but can be withdrawn into the body of the chair frame and stored together with the chair. The sun-shading device does not require time for connection to the chair and can be easily unfolded to a working position by merely pulling it out from the hollow parts of the chair frame into which the frame of the sun-shading device is telescopically inserted.

The chair can be conveniently stored and carried out together with the sun-shading device which has a very light weight and, when not in use, is completely hidden inside the frame elements of the chair.

Although the invention has been shown and described with reference to specific embodiments, it is understood that these embodiments should not be construed as limiting the areas of application of the invention and that any changes and modifications are possible, provided these changes and modifications do not depart from the scope of the attached patent claims. For example, the chair is not necessarily foldable and may have any other suitable construction. The chair may comprise a chaise longue. The rods 32*a*1, 32*a*2, and 32*b*1, and 32*b*2 can extend automatically under the effect of springs located in the tubular frame elements 28*b* and 28*d*. The retractable strips 40 and 42 can automatically extend from the armrests 28*e* and 28*f* under the effect of springs. The term "cord" used in the specification may mean a string, wire, thread, etc.

The invention claimed is:

1. A chair with a built-in sun-protective device comprising: a chair frame composed of a seat frame, a back frame, and armrests; and a sun-protective device having a sun-shading blind and frame members moveably built into the back frame and the armrests with the possibility of retracting the frame members of the sun-protective device from the back frame and the armrests to a working position with the sun-shading blind above the back frame and the seat frame and with possibility of withdrawing said frame members of the sun-protective device into hidden positions in which they are hidden in said back frame and said armrests, wherein the back frame of said chair frame comprises a pair of hollow tubular members that have upper ends and a first cross bar that interconnects said upper ends of the hollow tubular members of the back frame, the frame members of the sun-protective device comprising retractable rods telescopically inserted into the hollow tubular members of the back frame, said retractable rods having inner ends and outer ends, said outer ends of the retractable rods being interconnected by a second cross bar that rests onto said first cross bar when the sun-protective device is withdrawn into said hidden positions, the aforementioned armrests being hollow and having guides inside said armrests and retractable strips that have outer ends located in said armrests on the guides, said retractable strips that can be retracted forward from the armrests along said guides or withdrawn into a position inside the armrests where said retractable strips are hidden, the upper ends of the hollow tubular members of the back frame and the front ends of the retractable strips being connected by flexible members that are used for supporting and guiding said sun-shading blind.

2. The chair of claim 1, wherein the flexible members are cords and wherein the sun-shading blind is a piece of fabric that can slide along said cords.

3. The chair of claim 2, wherein said front ends of the retractable strips support spring-loaded cord-winding members that maintain said cords in tension when the retractable rods are retracted from the hollow tubular members of the back frame and the retractable strips are retracted from the armrests.

4. The chair of claim 3, where the armrests have upper surfaces and grooves formed in said upper surfaces for accommodating said cords when the retractable rods and the retractable strips are withdrawn into the back frame of the chair and into the armrests, respectively.

5. The chair of claim 2, where the armrests have upper surfaces and grooves formed in said upper surfaces for accommodating said cords when the retractable rods and the retractable strips are withdrawn into the back frame of the chair and into the armrests, respectively.

6. The chair of of claim 1, further comprising tensioning means pivotally supported by said back frame and rotatable into a position of providing tension for said sun-shading blind.

7. The chair of claim 6, wherein the tensioning means comprise a pair of blind-tightening arms that can be turned between the first position where said blind-tightening arms rests on said hollow tubular members of the back frame and the second position where said blind-tightening arms raise the sun-shading blind, thus providing a greater space between the blind and said chair frame.

8. The chair of claim 7, wherein the tensioning means comprise a pair of blind-tightening arms that can be turned between the first position where said blind-tightening arms rests on said hollow tubular members of the back frame and the second position where said blind-tightening arms raise the sun-shading blind, thus providing a greater space between the blind and said chair frame.

* * * * *